US005211314A

United States Patent [19]

Burrows

[11] Patent Number: 5,211,314

[45] Date of Patent: May 18, 1993

[54] SYRUP DISPENSER AND VALVE ASSEMBLY

[75] Inventor: Bruce D. Burrows, Valencia, Calif.

[73] Assignee: Ebtech, Inc., Columbus, Ohio

[21] Appl. No.: 813,782

[22] Filed: Dec. 27, 1991

[51] Int. Cl.[5] ..... B67D 5/06

[52] U.S. Cl. ..... 222/185; 222/481.5; 222/504

[58] Field of Search ..... 222/129.1-129.4, 222/57, 188, 325, 479, 482, 481.5, 484, 522, 504, 523, 509, 532, 537, 559, 640, 641, 525; 215/309, 311

[56] References Cited

U.S. PATENT DOCUMENTS

| | | | |
|---|---|---|---|
| 1,165,711 | 11/1915 | Ransom, Jr. | 222/484 |
| 2,440,112 | 4/1948 | Nellson | 222/484 |
| 2,808,182 | 10/1957 | Furedi | 222/479 |
| 3,193,143 | 10/1962 | Maieli | 222/640 |
| 3,341,073 | 9/1967 | Arps et al. | 222/641 |
| 3,606,096 | 9/1971 | Campbell | 222/479 |
| 3,802,606 | 4/1974 | Gust | 222/181 |
| 3,920,149 | 11/1975 | Fortino | 222/1 |
| 3,993,218 | 11/1976 | Reichenberger | 222/30 |
| 4,124,146 | 11/1978 | Sealfon | 222/641 |
| 4,398,652 | 8/1983 | Ueda et al. | 222/479 |
| 4,509,655 | 4/1985 | Killmann | 222/484 |
| 4,523,697 | 6/1985 | Jeans | 222/185 |
| 4,570,830 | 2/1986 | Jeans | 222/185 |
| 4,664,292 | 5/1987 | Jeans | 222/1 |
| 4,722,463 | 2/1988 | Anderson | 222/185 |
| 4,793,514 | 12/1988 | Sheets | 222/185 |
| 4,807,785 | 2/1989 | Pritchett | 222/525 |
| 4,854,486 | 8/1989 | Daley et al. | 222/484 |
| 4,898,308 | 2/1990 | Rudick | 222/325 |
| 5,133,482 | 7/1992 | Burrows et al. | 222/185 |

FOREIGN PATENT DOCUMENTS

| | | | |
|---|---|---|---|
| 88078 | 10/1936 | Fed. Rep. of Germany | 222/484 |

*Primary Examiner*—Andres Kashnikow
*Assistant Examiner*—Philippe Derakshani
*Attorney, Agent, or Firm*—Kelly Bauersfeld & Lowry

[57] ABSTRACT

An improved syrup dispenser and valve assembly are provided for dispensing a liquid, such as a flavor syrup in a soft drink dispenser station or the like. The valve assembly comprises a compact base member adapted to mount directly into the neck of a flavor syrup bottle, in combination with a movable valve member mounted thereon and cooperating therewith to define a syrup dispense port and an air vent port. The bottle is designed for inverted installation into the dispenser station with the bottle neck seated within a station support socket, and with the valve member operatively engaged by a station actuator. The station actuator displaces the valve member between a first position closing the syrup dispense and air vent ports, and a second position opening both of said ports to permit gravity syrup outflow with the dispensed syrup volume being replaced by air inflow into the bottle.

20 Claims, 7 Drawing Sheets

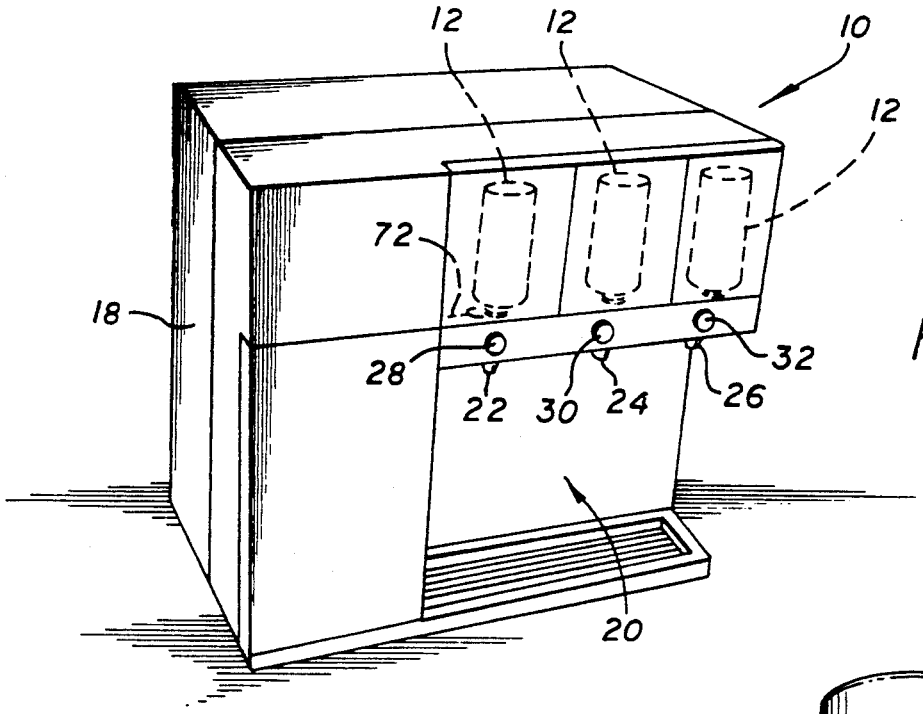
FIG. 1
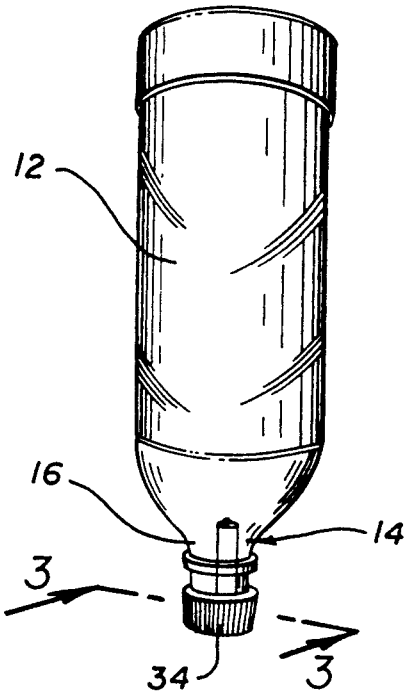
FIG. 2
FIG. 3
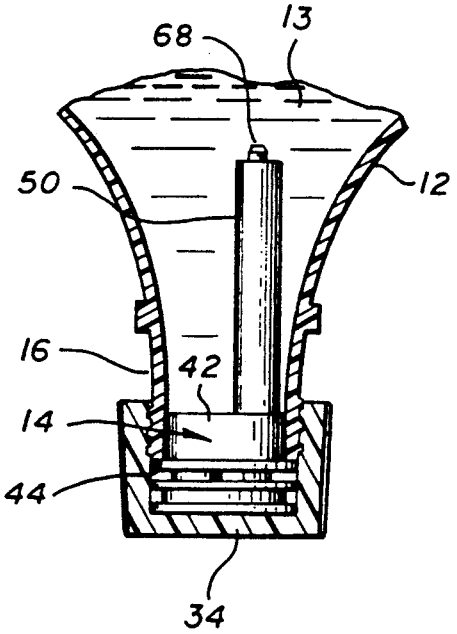

FIG. 8
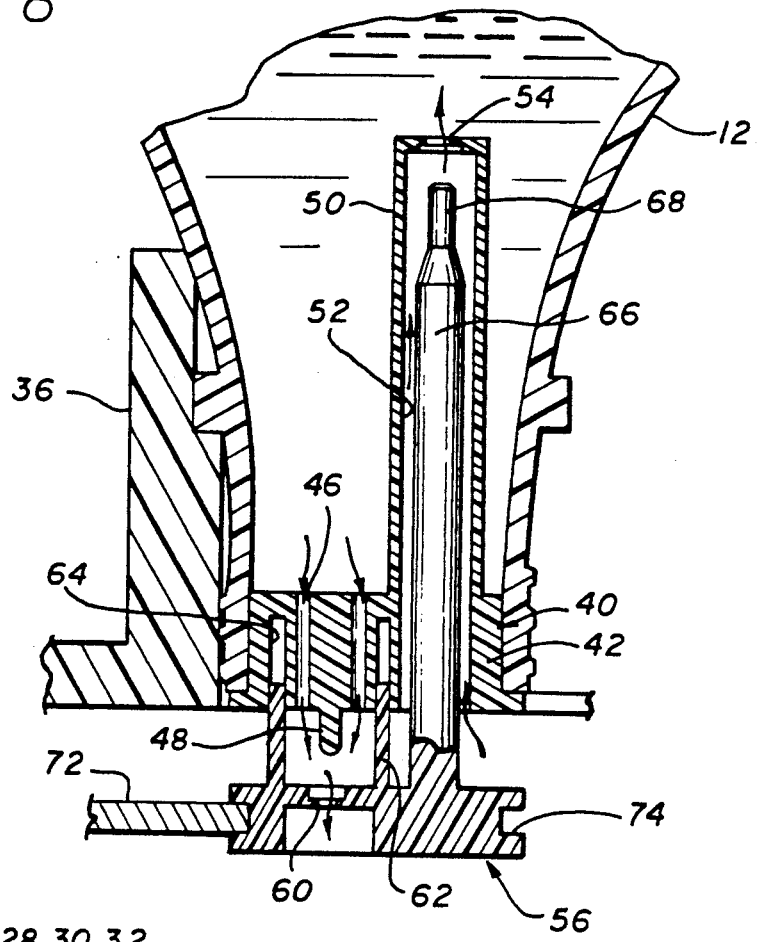
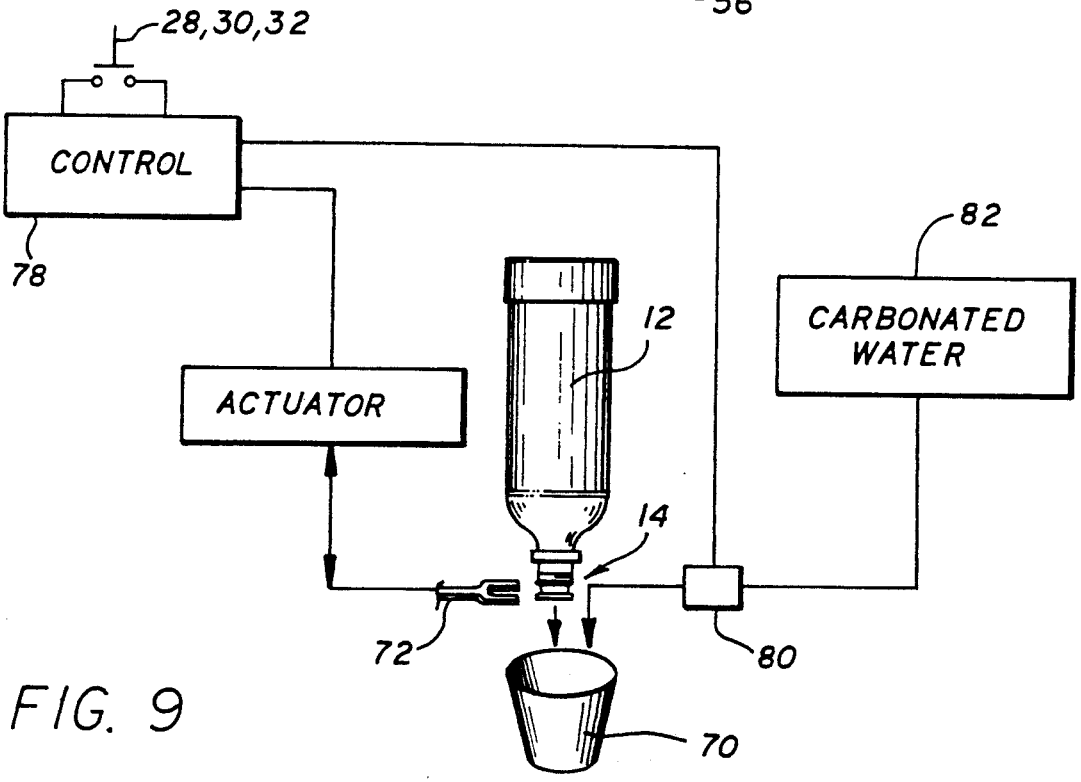
FIG. 9

FIG. 15
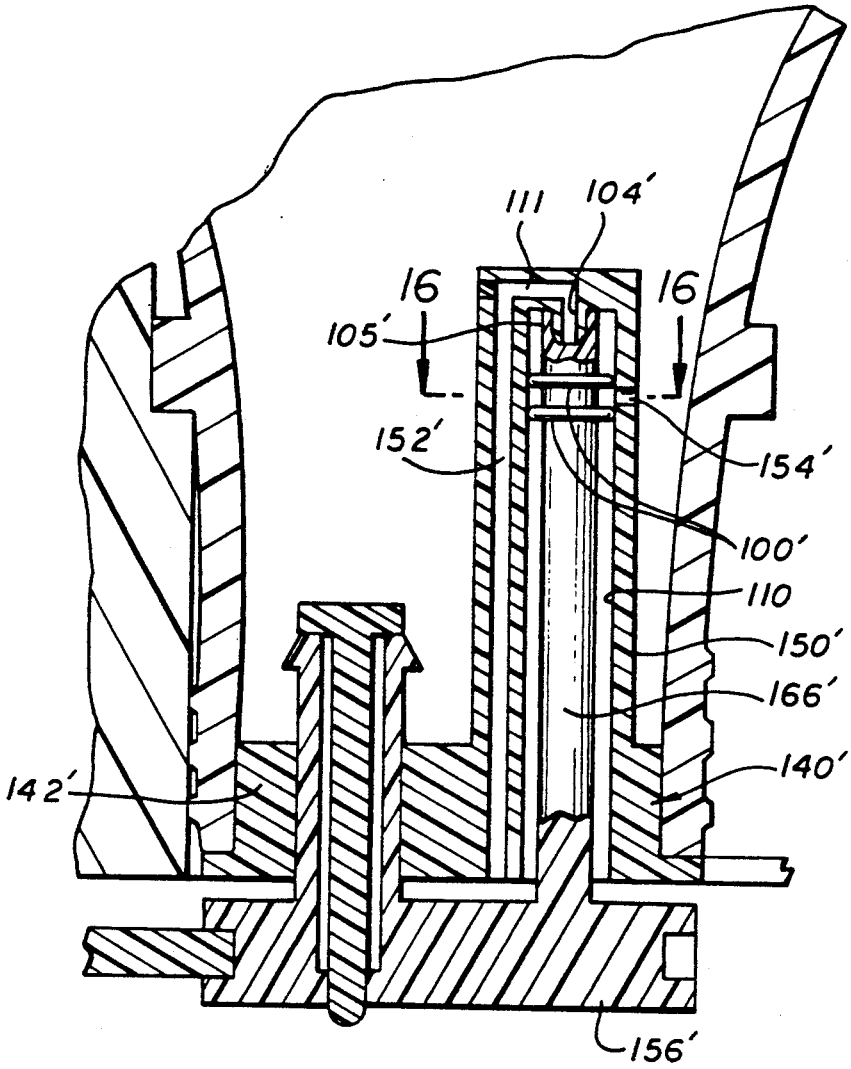
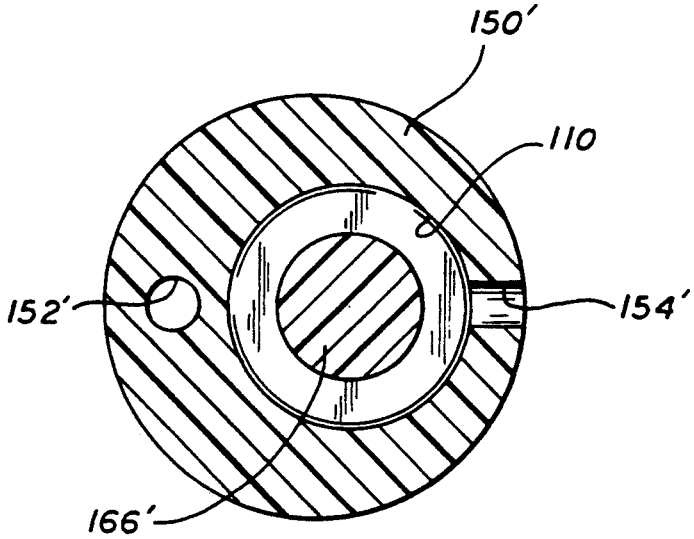
FIG. 16

SYRUP DISPENSER AND VALVE ASSEMBLY

BACKGROUND OF THE INVENTION

This invention relates generally to dispensing valves for use in regulated dispensing of liquids, particularly such as dispensing of flavor syrups and the like used in soft drink dispenser stations for mixing and dispensing soft drink beverages. More specifically, this invention relates to an improved yet compact and simplified valve assembly adapted for installation directly into the neck of a bottle containing a flavor syrup or the like, wherein the valve assembly is designed for relatively simple yet accurately controlled operation to dispense discrete increments of the syrup.

Soft drink dispenser stations and/or vending machines and the like are generally known in the art for use in dispensing soft drink beverages in individual servings, typically on the order of about 6 to 10 ounces per serving. Such dispenser stations commonly include a water reservoir adapted to receive and store a supply of fresh water typically in chilled and carbonated form, together with one or more separate bottles containing flavor syrup. When a beverage serving is desired, the dispenser station regulates the flow of proportioned quantities of the chilled water and the selected flavor syrup for mixture and dispensing into a drinking cup, glass, etc. Since the flavor syrup is normally provided in concentrated form, a relatively small volumetric proportion of the flavor syrup is delivered for each serving, in comparison with a significantly larger volumetric quantity of the chilled water. Accordingly, accurate delivery of closely regulated or metered volumes of the flavor syrup is extremely important to ensure dispensing of a consistent and high quality beverage product to the consumer. Relatively minor variations in the dispensed syrup quantity can result in significant and undesirable fluctuations in the taste of the final beverage.

In the past, soft drink flavor syrups have been provided in containers of various sizes and shapes adapted for association with valve apparatus through which the flavor syrup is dispensed. In one common form, relatively sturdy syrup containers such as metal canisters or the like have been connected to a positive pressure gas for delivering the syrup under relatively constant high pressure conditions through appropriate metering valves. However, such syrup containers are relatively costly and are not adapted for economic disposal when empty. Moreover, the associated pressurizing gas and related flow conduits and valve mechanisms are relatively complex in construction to result in a relatively costly dispenser station.

More recently, disposable syrup containers in the form of lightweight plastic bottles have been proposed for gravity feed dispensing of flavor syrup. Such gravity feed bottles are normally installed in an inverted position with the bottle neck seated in a support socket having regulatory valve apparatus integrated therein. In some designs, the interior of the inverted syrup bottle is vented to atmosphere, such that gravity dispensing of syrup may occur under constant and/or relatively low pressure head conditions. In most designs of this general type, however, the valve apparatus has continued to require a variety of moving parts in combination with relatively complex operating structures, resulting again in a relatively costly dispenser station construction. See, for example, U.S. Pat. Nos. 4,664,292 and 4,523,697. See also U.S. Pat. No. 4,570,830 which discloses a similar, relatively complex valve apparatus adapted for rotary activation.

Still further alternative dispenser station proposals have incorporated relatively simple valve and vent components mounted directly within the neck of a flavor syrup bottle and adapted for electromagnetic actuation by means of a solenoid coil integrated into the bottle support socket on the dispenser station. See, for example, U.S. Pat. No. 5,133,482. While such electromagnet actuated valve structures beneficially provide a simple and relatively cost efficient construction, such valve components may occasionally stick or exhibit sluggish operation as a result of contact with the relatively sticky and somewhat viscous flavor syrup.

The present invention provides further improvements in a dispenser valve assembly designed particularly for use with gravity feed syrup bottles and the like, wherein the valve assembly is adapted for mounting directly into the bottle neck of a flavor syrup bottle, and further wherein the valve assembly includes a relatively simple construction with a minimum number of movable valve components designed for accurate and reliable operation. Moreover, the improved valve assembly provided by the present invention may be economically disposed with the syrup bottle when the syrup supply therein is exhausted.

SUMMARY OF THE INVENTION

In accordance with the invention, an improved syrup dispenser system and related valve assembly are provided for use in controlled dispensing of liquids from a container, particularly such as dispensing of precision quantities of flavor syrup in a soft drink dispenser station or the like. The valve assembly is adapted for mounting directly into the neck of a syrup-containing bottle, and includes a minimum number of valve components adapted for precision controlled operation to dispense repeatable accurate quantities of flavor syrup under the influence of a substantially constant low pressure fluid head.

The dispenser and valve assembly of the present invention are particularly adapted for use with relatively compact and preferably disposable plastic bottles containing concentrated flavor syrup for use in a soft drink dispenser station which mixes and dispenses soft drink beverages. In such dispenser stations, regulated quantities of the flavor syrup are dispensed from the syrup-containing bottle for mixture with a proportioned quantity of chilled and typically carbonated water to produce a pleasing soft drink beverage.

The improved valve assembly has a compact size and shape for installation directly into the neck of the syrup-containing bottle, and in a manner permitting normal mounting of a bottle cap onto the bottle neck to maintain the bottle contents in a clean and sanitary condition. When the bottle is used, the cap is removed and the bottle is inverted for seated placement of the bottle neck into a mating support socket forming a portion of the dispenser station. In a preferred arrangement, the support socket positions the bottle directly above an appropriate receptacle such as a cup or the like for receiving the flavor syrup and carbonated water used to produce the soft drink beverage. The valve assembly normally maintains the bottle in a substantially closed condition, substantially without fluid leakage, as the bottle is inverted and installed into the station support socket.

The valve assembly comprises a relatively compact base member having a size and shape for relatively close slide-fit reception into the bottle neck. The base member has one or more syrup flow apertures formed therein to permit syrup outflow from the bottle. In addition, the base member includes a vent tube projecting a short distance into the interior of the syrup-containing bottle, with an inboard end of the vent tube defining an air vent port for controlled venting of the bottle interior to atmosphere. A movable valve member is mounted on the base member and cooperates therewith for normally closing the valve assembly to syrup outflow or air inflow to the bottle. The valve member further includes an actuator slot disposed at the outboard side of the base member and slightly beyond the end of the bottle neck for operative engagement by an actuator on the dispenser station at the bottle support socket. The dispenser station includes control means for displacing the actuator through a short and substantially linear reciprocal movement stroke to displace the movable valve member between a first position closing the bottle to syrup and air vent flow, and a second position permitting syrup outflow and accompanying air vent inflow.

In accordance with further aspects of the invention, the movable valve member and/or the associated base member of the improved valve assembly are constructed from molded plastic materials or the like to define a syrup outflow port and the air vent port, in combination with post-shaped valve heads for sliding press-fit reception into these ports when the valve member is in the first or closed position. With this geometry, positive port closure is obtained with the tight interfitting components tending to clear residual syrup from the ports. As a result, upon subsequent movement of the valve member to the open position, the ports remain free and unclogged for reliable and repeatable liquid dispensing.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a front perspective view of a soft drink dispenser station adapted for use with flavor syrup bottles equipped with the improved dispenser valve assembly embodying the novel features of the invention;

FIG. 2 is a perspective view depicting one of the syrup bottles having the improved dispenser valve assembly mounted therein;

FIG. 3 is an enlarged fragmented vertical sectional view taken generally on the line 3—3 of FIG. 2;

FIG. 8 is an enlarged fragmented vertical sectional view similar to FIG. 7, but illustrating the valve assembly in an open position to permit syrup flow therethrough;

FIG. 9 is a schematic diagram illustrating regulated operation of the valve assembly to produce soft drink beverages;

FIG. 15 is an enlarged fragmented vertical sectional view of another alternative preferred form of the valve assembly shown in a closed position; and FIG. 16 is a horizontal sectional view taken generally on the line 16—16 of FIG. 15.

DETAILED DESCRIPTION OF THE PREFERRED EMBODIMENT

Figure 4:
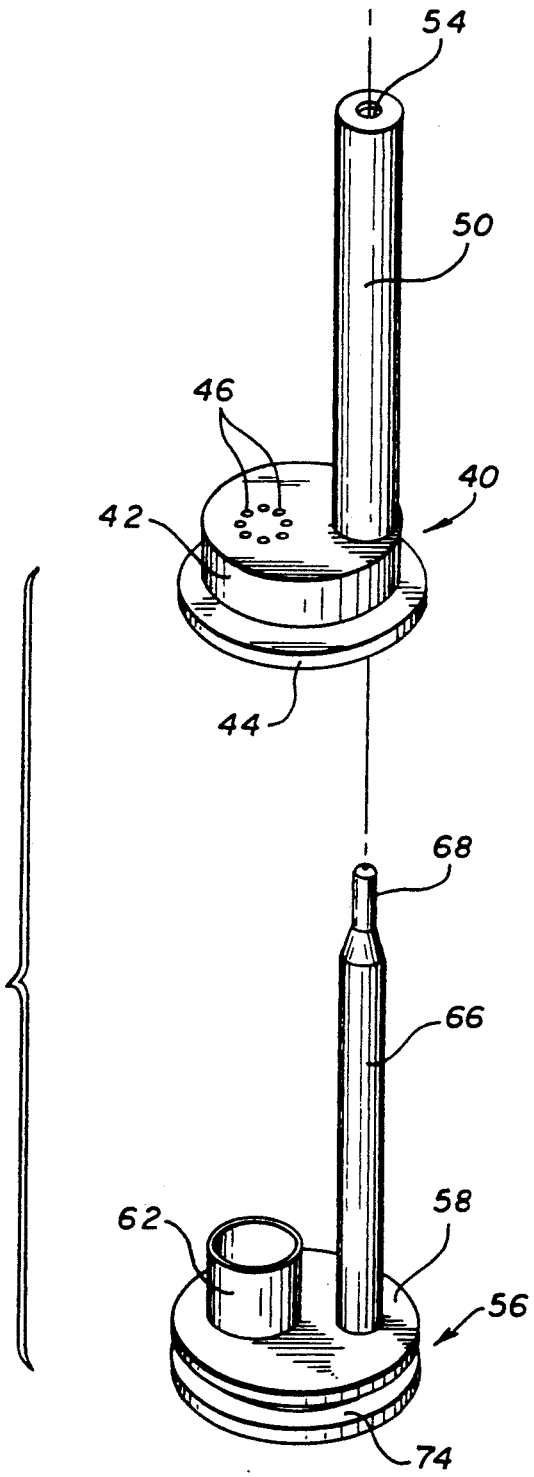
FIG. 4 is an enlarged and exploded perspective view depicting components of the improved valve assembly.

As shown in the exemplary drawings, a soft drink dispenser station referred to generally in FIG. 1 by the reference numeral 10 includes one or more relatively small bottles 12 containing flavor syrup 13 (FIG. 3) used in making soft drink beverages. As shown in FIGS. 2 and 3, each of the syrup-containing bottles 12 includes a relatively compact dispenser valve assembly 14 mounted directly into the neck 16 of the bottle, wherein the valve assembly is designed for closely and accurately regulating syrup outflow from the bottle during normal operation of the dispenser station.

More particularly, the illustrative soft drink dispenser station 10 is constructed generally in a manner known in the art to include a station housing 18 which may be sized and shaped for a convenient and compact countertop installation. The exemplary housing 18 defines a forwardly open receptacle 20 for receiving a drinking cup (not shown) or the like in a filling position disposed immediately below any one of three separate dispensing nozzles 22, 24 and 26. These nozzles 22, 24 and 26 are respectively associated with a corresponding number of the syrup-containing bottles 12 adapted for removable mounting within the station housing 18. In addition, the dispensing nozzles are further associated with individual dispense actuators such as the illustrative dispense buttons 28, 30 and 32. Depression of any one of the dispense buttons 28, 30 and 32 initiates station operation in a manner delivering and mixing proportionate quantities of the flavor syrup from the selected associated bottle 12 and chilled water, typically carbonated, from a water reservoir (not shown in FIG. 1) within the station housing. For a further and more detailed detailed discussion of soft drink dispenser stations of this general type, see U.S. Pat. No. 5,071,595, which is incorporated by reference herein. Moreover, although the illustrative drawings show a countertop size dispenser station 10 and relatively small volume syrup-containing bottles, it will be understood that the invention is equally applicable to dispenser stations and other fluid dispense apparatus of various size and type.

The improved syrup dispenser valve assembly 14 of the present invention is mounted directly into the neck 16 of the associated syrup-containing bottle 12, subsequent to bottle filling with the syrup 13 or the like of selected flavor. Importantly, the valve assembly 14 has a relatively compact and simple construction adapted for economical manufacture predominantly from lightweight molded plastic components or the like, and to fit relatively easily into the neck 16 of a conventional blow-molded or otherwise suitably formed plastic or glass bottle of selected volumetric capacity. Moreover, the valve assembly 14 accommodates threaded or similar mounting of a conventional bottle cap 34 onto the bottle neck, with the cap 34 maintaining the syrup contents and the installed valve assembly 14 in a clean and sanitary condition prior to usage.

Figure 5:
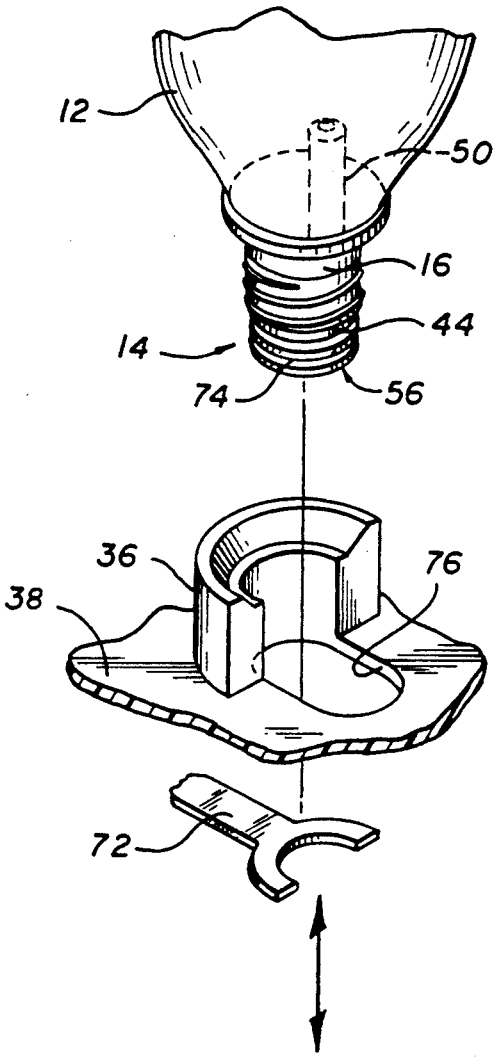
FIG. 5 is an enlarged fragmented and exploded perspective view showing engagement of a flavor syrup bottle with a mating support socket forming a portion of the soft drink dispenser station.

When one of the syrup-containing bottles 12 of the dispenser station 10 (FIG. 1) reaches an empty condition, a filled replacement bottle including the improved valve assembly 14 can be installed quickly and easily. That is, the empty bottle 12 can be removed from the station 10 and replaced by the filled bottle 12 including the valve assembly 14. In this regard, as viewed in FIG. 5 the station 10 includes a support socket 36 projecting upwardly from a platform 38 and adapted for drop-in reception of the bottle neck 16 with the bottle 12 inverted.

Figure 6:
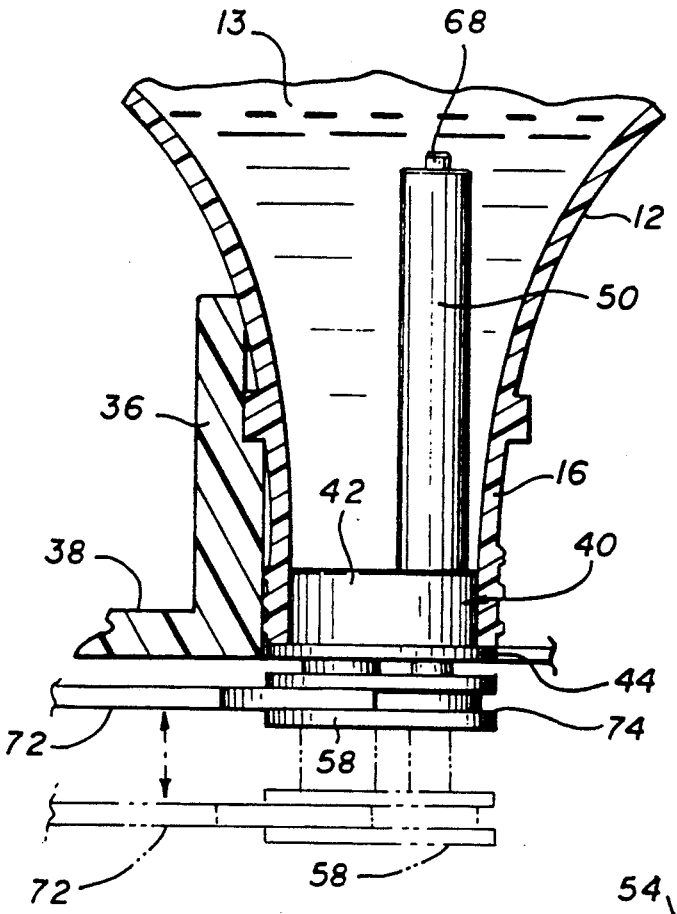
FIG. 6 is an enlarged fragmented vertical sectional view showing the flavor syrup bottle seated within the station support socket, with the dispenser valve assembly shown in elevation in a closed condition to prevent syrup flow therethrough.

As shown best in FIGS. 3, 4 and 6, the valve assembly 14 comprises a base member 40 having a generally circular base plate 42 sized for relatively snug, slide-fit reception into the open end of the bottle neck 16. An outwardly radiating flange 44 on the base plate 42 is positioned to abut the end of the bottle neck. In the preferred form, the base plate 42 is securely and permanently mounted within the bottle neck, such as by forming the base member from a plastic material adapted for ultrasonic welding to a blow-molded plastic bottle. Alternately, the base member can be secured within the bottle neck by other suitable means, such as by use of an adhesive, or a press-fit connection, etc.

Figure 7:
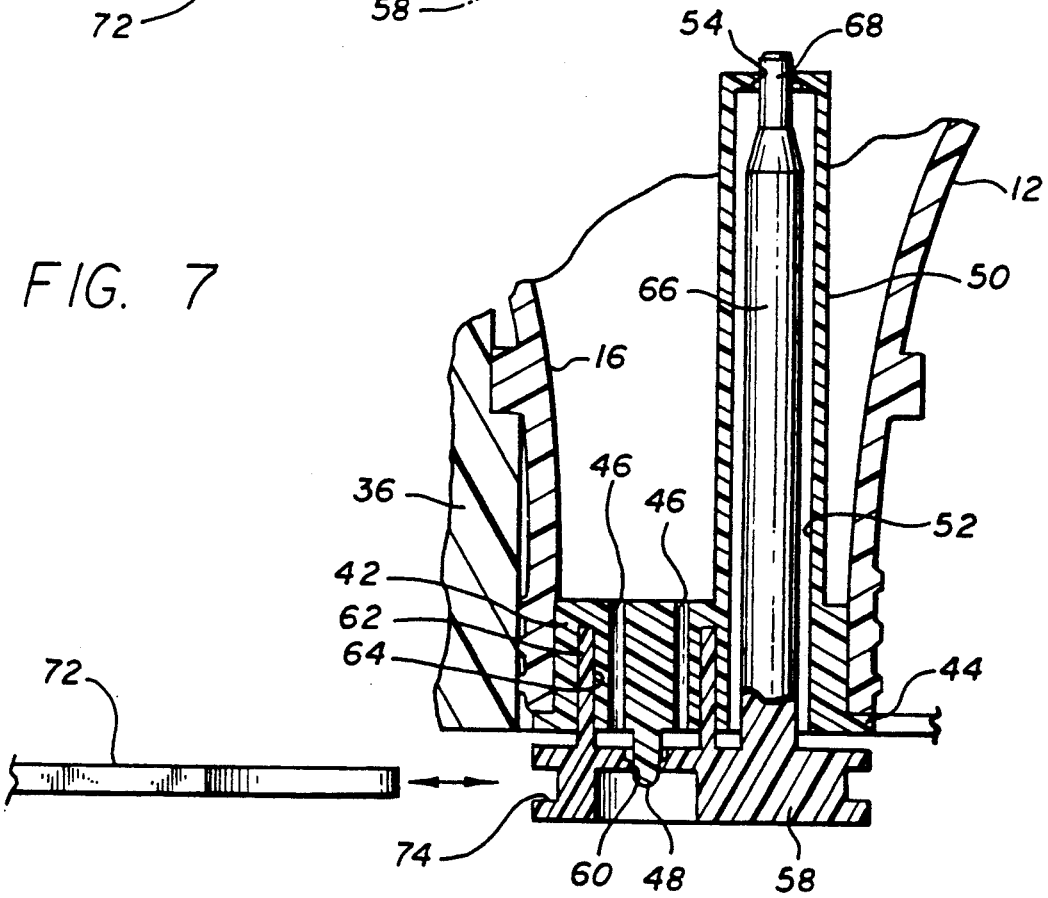
FIG. 7 is an enlarged fragmented vertical sectional view similar to FIG. 5, but depicting the valve assembly in vertical section.

The base member 40 defines a syrup flow path for dispensing of syrup from the bottle in the course of normal operation of the soft drink dispenser station. FIG. 4 illustrates this flow path in the form of a circularly arranged plurality of small flow apertures 46 formed in the base plate 42. As shown in FIG. 7, these flow apertures 46 are oriented in surrounding relation to a short post-shaped valve head 48 projecting outwardly from the base member 40.

The base member 40 additionally defines an air vent tube 50 for admitting air into the interior of the bottle to replace dispensed syrup. The vent tube 50 is formed as an integral part of the base member 40 to extend from the base plate 42 a short distance into the interior of the bottle 12. The base plate 42 and the vent tube 50 cooperatively define a relatively large and open vent passage 52 (FIG. 7) leading from the exterior of the bottle to a small vent port 54 at the inboard or free end of the vent tube 50.

The improved valve assembly 14 additionally includes a movable valve member 56 mounted onto the base member 40 for back-and-forth, substantially linear reciprocal motion to regulate syrup dispensing and bottle venting. The preferred valve member 56 comprises a disk-shaped valve plate 58 having a size and shape for overlying the base plate 42 at a position slightly beyond the end of the bottle neck 16. The valve plate 58 is also formed as a one-piece plastic molding or the like and includes a small syrup dispense port 60 (FIG. 7) positioned for slide-fit reception of the syrup valve head 48. A sealing sleeve 62 on the valve plate 58 protrudes with a sealing slide-fit relation into an annular channel 64 in the base plate 42 to prevent syrup leakage between the base member 40 and the valve member 56.

The valve member 56 additionally includes an elongated valve stem 66 projecting from the valve plate 58 through the vent passage 52 in air flow clearance relation with the vent tube 50 and the base plate 42. A distal or free end of the valve stem 66 defines a post-shaped vent valve head 68 for normal slide-fit and sealing reception into the vent port 54.

The valve member 56 is constructed, in combination with the configuration of the base member 40, for movement between first and second positions to respectively open both of the syrup and vent ports 60 and 54, or to close both of said ports. In the closed position as viewed in FIG. 7, the valve plate 58 is positioned relatively close to but in slightly spaced relation from the base plate 42, with the sealing sleeve 62 bottomed against the end of the annular channel 64. In this position, the syrup valve head 48 protrudes through and closes the syrup dispense port 60, whereas the vent valve head 68 protrudes through and closes the vent port 54. Moreover, the slightly spaced relation between the base plate 42 and valve plate 58 maintains the vent passage 52 in communication with atmospheric air.

Movement of the valve member 56 through a short stroke in a direction away from the base plate 42, toward the dotted line position as viewed in FIG. 6, functions to open the syrup dispense port 60 to permit syrup outflow by gravity from the bottle 12. That is, the downward displacement as viewed in FIG. 6 to the second or open position (FIG. 8) retracts the dispense port 60 from the syrup valve head 48, such that syrup downflow through the ring of apertures 46 may pass freely through the dispense port 60 and into an underlying cup or the like. Importantly, in the second or open position, the sealing sleeve 62 is not withdrawn completely from the annular channel 64 in the base plate 40 to prevent syrup leakage between the valve assembly components.

Syrup dispensing is accompanied by withdrawal of the vent valve head 68 from the air vent port 54 to permit air inflow into the bottle. That is, initial syrup outflow from the bottle effectively creates a small vacuum within the bottle for purposes of drawing air into the bottle interior. In this regard, the configurations of the valve assembly components may be designed for substantially simultaneous opening of the dispense port 60 and the air vent port 54. Alternately, in a preferred form, the valve assembly components are configured to open the syrup dispense port 60 slightly in advance of vent port opening, thereby permitting initiation of syrup outflow and creation of a small bottle vacuum before vent flow is permitted.

The duration of valve member movement to the open or second position as viewed in FIG. 8 effectively regulates the quantity of syrup dispensed to an underlying receptacle, such as a drinking cup 70 viewed in FIG. 9.

The valve member movement is controlled by an actuator 72 mounted on the station 10 at the bottle support socket 36 for engaging and operating the valve member between the open and close positions. The illustrative drawings show a fork-shaped actuator 72 designed for slide-fit engagement into an annular external slot 74 on the valve plate 58. In this regard, the support socket 36 may have a part-circular configuration to support the bottle 12 in an inverted position, in association with an oblong or elongated opening 76 (FIG. 5) in the platform 38. With this configuration, the neck 16 of a fresh or filled bottle 12 can be fitted through the platform opening 76, followed by lateral motion of the bottle for seated support within the socket 36, and concurrent engagement of the actuator 72 with the valve plate 58.

As viewed in FIG. 9, the actuator 72 is controlled by a main controller 78. The controller 78 responds to manual depression of one of the station buttons 28, 30, 32 to displace the actuator 72 in a manner providing syrup dispensing for a predetermined time interval, followed by return displacement to halt syrup dispensing. At or about the same time interval, a water valve 80 is operated by the controller device 78 to dispense chilled and carbonated water from an appropriate reservoir 82 in parallel with the dispensed syrup to the underlying cup 70.

The improved valve assembly of the present invention thus provides a relatively simple two-piece structure which can be mounted directly into the neck 16 of a syrup-containing bottle 12 or the like, wherein the valve assembly is adapted for simple linear reciprocation between open and closed positions for syrup dispensing and bottle venting. The components of the valve assembly are conveniently adapted for economical manufacture as lightweight molded plastic components or the like. The post-shaped valve heads protrude through the associated valve ports with a sufficient compressive scraping and cleaning action to prevent accumulation of syrup residue which could otherwise interfere with syrup dispensing accuracy. When the bottle is empty, the entire bottle inclusive of the installed valve assembly may be economically discarded.

Figure 10:
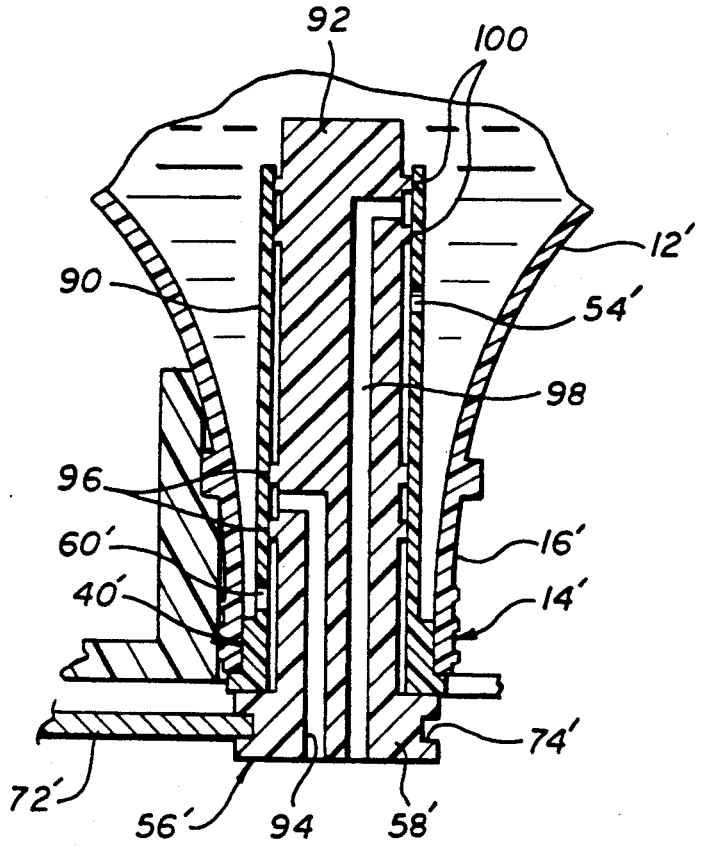
FIG. 10 is an enlarged fragmented vertical sectional view similar to FIG. 7 and illustrating one alternative preferred form of the invention, with the valve assembly in a closed condition.
Figure 11:
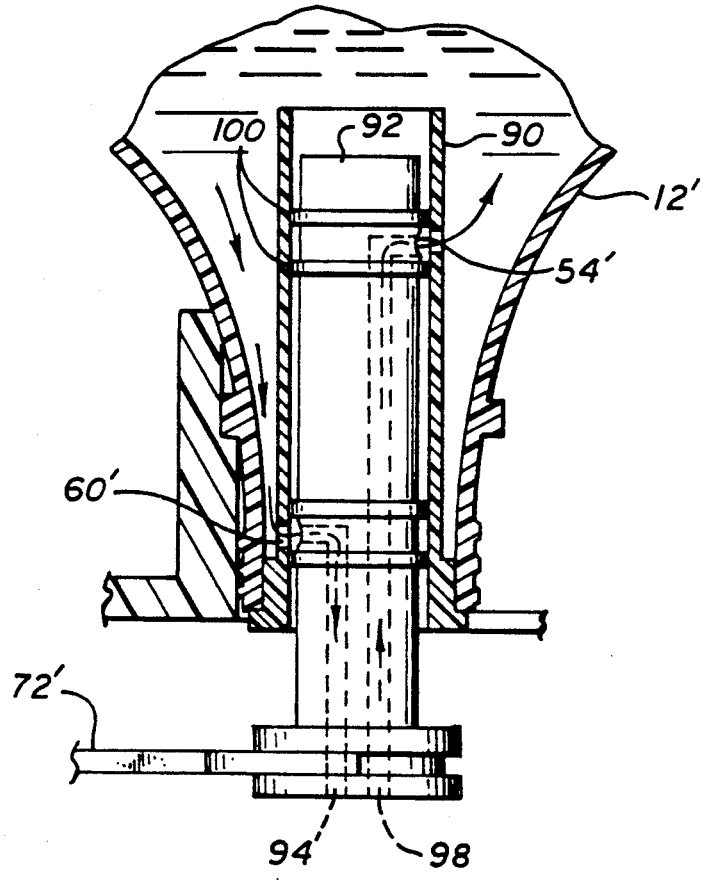
FIG. 11 is an enlarged fragmented vertical sectional view similar to FIG. 10, but depicting the dispenser valve assembly in an open condition.

FIGS. 10 and 11 illustrate one alternative form of the invention, wherein components which are otherwise identical in structure and/or function to those described in FIGS. 1–8 are referred to by common primed reference numerals. As shown, the alternative valve assembly 14' includes a base member 40' mounted within the neck 16' of a bottle 12'. The base member includes an elongated valve sleeve 90 having a syrup flow port 60' formed therein at a position near the end of the bottle neck, and an air vent port 54' formed at a position spaced a short distance into the bottle interior.

The syrup dispense and air vent ports 60' and 54' are controllably opened or closed by a movable valve member 56' having an outer valve plate 58' with an annular slot 74' formed thereon for operative reception of and engagement by the yoke-shaped actuator 72', as previously described. In this embodiment, the valve member 56' includes an elongated valve plug 92 extending into and through the valve sleeve 90 of the base member 14' to regulate syrup outflow and air vent inflow. More particularly, a syrup dispense passage 94 is formed in the valve plug, with an inboard end disposed alignment with the syrup dispense port 60'. Similarly, an air vent passage 98 is formed in the valve plug and has an inboard end disposed between a pair of seal rings 100 for selective alignment with the air vent port 54'. The actuator 72' displaces the valve plug back-and-forth between a closed position with the flow passages 94 and 98 misaligned with the ports 60' and 40', and an open position with the flow passages 94 and 98 in flow alignment with the ports 60' and 54' for syrup dispensing and bottle venting, in the manner as previously described (FIG. 11).

Figure 12:
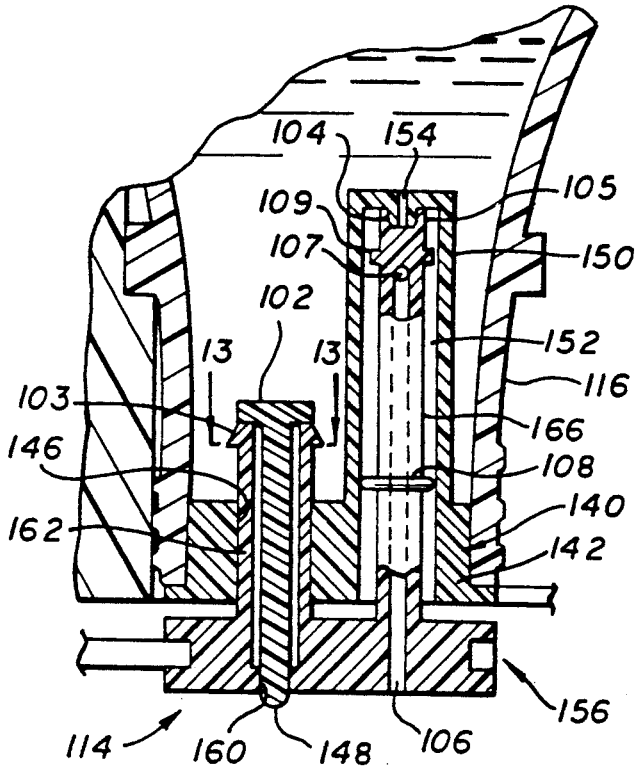
FIG. 12 is an enlarged fragmented vertical sectional view similar to FIG. 10, but depicting another alternative preferred valve assembly embodiment of the invention shown in a closed condition.
Figure 13:
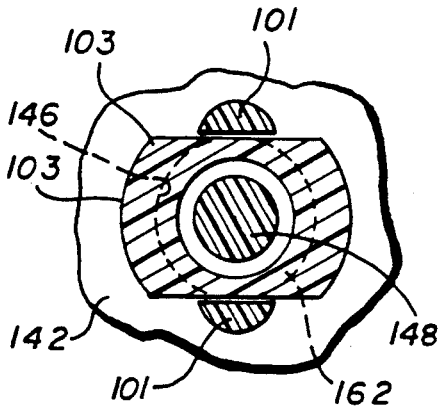
FIG. 13 is an enlarged fragmented horizontal sectional view taken generally on the line 13—13 of FIG. 12.
Figure 14:
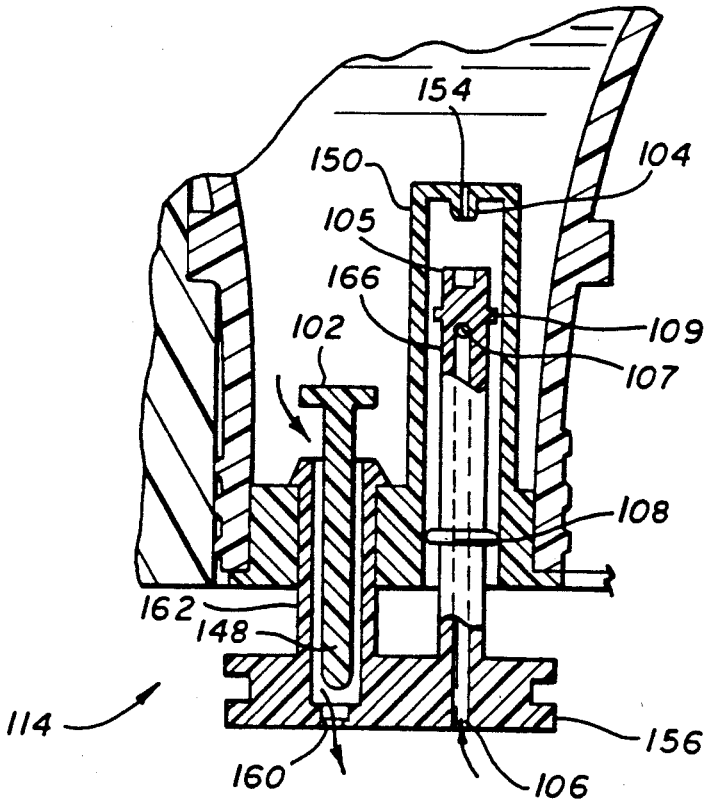
FIG. 14 is an enlarged fragmented vertical sectional view similar to FIG. 12, but depicting the valve assembly in an open condition.

FIGS. 12–14 depict another alternative preferred form of the invention wherein components corresponding with those shown and described in FIGS. 2–8 are referred to by common reference numerals increased by one hundred. As shown, a modified valve assembly 114 has a two-piece construction with a base member 140 mounted within the neck of 116 of a syrup-containing bottle, in association with a reciprocal valve member 156. In this embodiment, a syrup valve is formed by a relatively large syrup outflow passage 146 formed in a base plate 142 of the base member 140, with a pair of support legs 101 protruding into the bottle from opposite sides of the passage 146 to terminate at a disk-shaped valve seat 102. A post-shaped valve head 148 is formed in turn on the valve seat 102, and projects through the passage 146 in clearance relation therewith to the outboard side of the base plate. A generally tubular valve sleeve 162 formed at the inboard side of the valve member 156 fits with a slidable sealed action through the aperture 146, with outwardly projecting angled lock feet 103 adapted for snap-fit reception through the passage 146 to a position beyond the base plate 142 and between the support legs 101.

When the valve member 156 is in a first or closed position (FIG. 12), an inboard margin of the valve sleeve 162 sealingly engages the valve seat 102 to prevent downward syrup flow through the valve sleeve. In addition, the end of the valve head 148 is sealingly received through a syrup outflow port 160 in the valve member. However, downward movement of the valve member 156 to the second or open position (FIG. 14) as described with respect to the previous embodiments effective to permit syrup outflow. That is, in the open position, the tubular valve sleeve 162 is separated from the valve seat 102, and the syrup outflow port 160 is displaced to a position beyond the end of the stem 148.

The embodiment of FIGS. 12–14 additionally include an improved vent valve for air inflow to the bottle as syrup is dispensed. More specifically, a vent tube 150 projects into the bottle at the inboard side of the base plate 142. The inboard or distal end of this vent tube 150 defines a vent port 154 shown in FIGS. 12 and 14 with a short sleeve-shaped seal cuff 104 at the outboard side thereof. A corresponding valve stem 166 projects in an inboard direction from the valve member 156 into the interior 152 of the vent tube 150, terminating in a cup-shaped stem tip 105 for substantially sealed slide-fit reception over the seal cuff 104. In addition, the vent valve stem 166 includes an internal vent path 106 leading from the exterior of the bottle to a laterally open port 107 disposed in spaced relation below the stem tip 105. A sealing ring 108 is formed on the stem 166 for sealingly engaging the vent tube 150 near the outboard end thereof, and a deflector shield 109 is formed between the stem tip 105 and the underlying lateral stem port 107 to protect the port 107 from clogging due to minor syrup dripping.

In operation, movement of the valve member 156 to close the syrup valve is additionally effective to engage the stem tip 105 with the seal cuff 104 on the vent tube 150. Accordingly, when the syrup valve is closed to prevent syrup outflow from the bottle, the vent valve is also closed to prevent air inflow to the bottle. However, movement of the valve member 156 to the open position (FIG. 14) retracts the stem seal tip 105 from the seal cuff 104. This permits air to be drawn through the stem path 106 and port 107, and around the deflector shield 109 to the vent port 154. Return movement of the valve member to the closed position (FIG. 12) reengages the seal tip and cuff 105 and 104 to close the vent port 154. In this closed condition, any residual syrup quantity disposed within the vent tube 150 is prevented from clogging the stem port 107 or the associated stem path 106 as a result of the protective deflector shield 109. Such residual syrup may accumulate over several valve cycles, and may drip over the edge of the deflector shield 109 to collect on the underlying seal ring 108.

FIGS. 15 and 16 illustrate another alternative form of the invention similar to the embodiment of FIGS. 12–14, to include a modified vent valve arrangement. For convenience and brevity of description, structural components which correspond with those shown and described in FIGS. 12–14 are identified by common primed reference numerals.

More particularly, as shown in FIGS. 16, the base member 140' installed with the bottle neck includes a hollow vent tube 150, projecting from a base plate 142' as short distance into the bottle interior. The vent tube 150' is formed to define a relatively small diameter vent passage 152' disposed alongside and in parallel with a larger diameter bore 110 for slide-fit reception of an elongated valve stem 166' on a reciprocal valve member 156'. The outboard end of both passages 152' and 110 are in open communication with atmosphere at the exterior of the bottle. An inner or inboard end of the vent passage 152' communicates through a short lateral bridge passage 111 which in turn opens through a short depending seal cuff 104' to the inner end of the stem bore 110.

The valve stem 166' projects into the stem bore 110 and includes an inner or inboard end defining a cup-shaped seal tip 105' for slide-fit sealing engagement with the seal cuff 104' when the valve member 156' is in the closed position. A pair of spaced apart seal rings 100' on the valve stem 166' engage the vent tube 150' within the stem bore 110', and at opposite sides of a vent port 154' disposed a short distance below the seal cuff 104', when the valve member is in the closed position. Accordingly, the seal rings 100' and the interfitting cuff and tip 104', 105' provide a double vent valve to prevent air inflow into the bottle or syrup leakage therefrom.

When the valve member 156' is moved to the open position, syrup outflow from the bottle is permitted in the same manner as described with respect to FIGS. 12–14. This opening movement is accompanied by downward displacement of the vent valve stem 166' within the vent bore 110 to separate the seal cuff 104' and stem tip 105', and additionally to move the seal rings 100' to a position below the vent port 154'. As a result, air inflow to the bottle is permitted through the vent passage 152' and the seal cuff 104' to the vent port. Return movement of the valve member 156' to the closed position positively re-closes the vent port and the seal cuff.

A variety of further modifications and improvements to the syrup dispenser and valve assembly will be apparent to those skilled in the art. Accordingly, no limitation on the invention is intended by way of the foregoing description and accompanying drawings, except as set forth in the appended claims.

I claim:

1. A dispenser valve assembly for mounting within the neck of a bottle to control dispensing of a liquid contained within the bottle, said dispenser valve assembly comprising:

a base member having a base plate mounted within the bottle neck and defining at least one liquid outflow port, said base member further including a vent tube projecting from said base plate a short distance into the bottle interior and defining a vent port, said base plate and vent tube cooperatively defining a vent passage for admitting air into the bottle interior; and a valve member mounted on said base member for linear reciprocal movement between first and second positions, said valve member including means for closing said liquid outflow port and said vent port when said valve member is in said first position to prevent fluid flow therethrough, and for opening said liquid outflow port and said vent port when said valve member is in said second position to permit fluid flow therethrough;

said valve member including an elongated valve stem projecting into said vent passage, said valve stem and said vent tube including slidably interengageable seal means for closing said vent port when said valve member is in said first position.

2. The dispenser valve assembly of claim 1 wherein said valve member is mounted on said base member at an outboard side thereof in a position at least partially exposed outside the bottle.

3. The dispenser valve assembly of claim 2 further including a cap for mounting onto the bottle neck and to cover said valve member to maintain said valve member in a substantially sanitary condition.

4. The dispenser valve assembly of claim 1 further including actuator means for displacing said valve member between said first and second position.

5. The dispenser valve assembly of claim 4 wherein said valve member includes a valve plate disposed at an outboard side of said base plate, said valve plate having an external slot formed therein, said actuator means being engageable within said slot with said valve plate.

6. The dispenser valve assembly of claim 1 wherein said base member comprises a one-piece plastic molding.

7. The dispenser valve assembly of claim 6 wherein said valve member comprises a one-piece plastic molding.

8. The dispenser valve assembly of claim 1 wherein said valve stem has a vent valve head at a free end thereof for protruding through said vent port in sealing relation therewith when said valve member is in said first position, and for retraction from said vent port to permit fluid flow therethrough when said valve member is in said second position.

9. The dispenser valve assembly of claim 8 further including a sealing sleeve slidably interengageable between said valve member and said base member in a position for flowpassage therethrough of liquid flowing from the bottle through said outflow port, said valve member further defining a dispense port positioned for outflow passage of liquid within said sealing sleeve, said base member including a dispense valve head for protruding through said dispense port in sealing relation therewith when said valve member is in said first position, and for retraction from said dispense port when said valve member is in said second position to permit liquid flow therethrough.

10. The dispenser valve assembly of claim 9 wherein said at least one outflow port comprises an annular array of outflow ports formed in said base plate.

11. The dispenser valve assembly of claim 9 wherein said dispense valve head and said vent valve head are formed for opening said dispense port slightly in advance of opening said vent port upon movement of said valve member from said first position to said second position.

12. The dispenser valve assembly of claim 1 wherein said valve member is formed for opening said liquid outflow port slightly in advance of opening said vent port upon movement of said valve member from said position to said second position.

13. This dispenser valve assembly of claim 1 wherein said valve stem further includes a seal ring slidably engageable with said vent tube, and a vent path formed in said valve stem to extend from the exterior of the bottle to a downstream path end defining a stem port communicating with said vent passage at a position between said seal ring and said vent port.

14. The dispenser valve assembly of claim 13 further including a shield member on said valve stem at a position between said stem port and said vent port to prevent syrup clogging of said stem port.

15. The dispenser valve assembly of claim 14 wherein said stem port is spaced a substantial distance along said valve stem from said seal ring.

16. The dispenser valve assembly of claim 1 wherein said seal means includes means defining at least two seal structures disposed along said vent passage for closing said vent passage to fluid flow when said valve member is in said first position, and for opening said vent passage to fluid flow when said valve member is in said second position.

17. The dispenser valve assembly of claim 1 wherein said vent passage within said vent tube comprises first and second passages extending from an outboard side of said base member in flow communication with air outside the bottle to opposite ends disposed within the bottle, and a bridge passage interconnecting said opposite ends of said first and second passages at a position spaced inwardly from said vent port, said vent port being in flow communication with said second passage, and said valve member including a valve stem projecting into said second passage and including means for closing said vent port when said valve member is in said first position and for opening said vent port in flow communication with said bridge passage when said valve member is in said second position.

18. The dispenser valve assembly of claim 17 wherein said valve stem further includes means for closing said bridge passage when said valve member is in said first position and for opening said bridge passage in flow communication with said bridge passage when said valve member is in said second position.

19. The dispenser valve assembly of claim 18 wherein said valve stem further includes seal means for preventing direct fluid flow between said vent port through said second passage to the exterior of the bottle.

20. A dispenser valve assembly for mounting within the neck of a bottle to control dispensing of a liquid contained within the bottle, said dispenser valve assembly comprising:

a base member having a base plate mounted within the bottle neck and defining at least one liquid outflow port, said base member further including a vent tube projecting from said base plate a short distance into the bottle interior and defining a vent port, said base plate and vent tube cooperatively defining a vent passage for admitting air into the bottle interior; and a valve member mounted on said base member for linear reciprocal movement between first and second positions, said valve member including means for closing said liquid outflow port and said vent port when said valve member is in said first position to prevent fluid flow therethrough, and for opening said liquid outflow port and said vent port when said valve member is in said second position to permit fluid flow therethrough; and actuator means for displacing said valve member between said first and second positions;

said valve member including a valve plate disposed at an outboard side of said base plate, said valve plate having an external slot formed therein, said actuator means being engageable within said slot with said valve plate.

* * * * *